US010408032B2

(12) United States Patent
Al-Muraikhi et al.

(10) Patent No.: US 10,408,032 B2
(45) Date of Patent: Sep. 10, 2019

(54) WELLBORE SYSTEM

(71) Applicant: Saudi Arabian Oil Company, Dhahran (SA)

(72) Inventors: Ahmad J. Al-Muraikhi, Dhahran (SA); Yanhui A. Wang, Dhahran (SA); Ivan G. Ramirez, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 22 days.

(21) Appl. No.: 15/279,150

(22) Filed: Sep. 28, 2016

(65) Prior Publication Data

US 2018/0087366 A1 Mar. 29, 2018

(51) Int. Cl.

| | |
|---|---|
| ***E21B 43/30*** | (2006.01) |
| ***E21B 43/14*** | (2006.01) |
| ***E21B 43/16*** | (2006.01) |
| ***E21B 43/18*** | (2006.01) |
| ***E21B 43/32*** | (2006.01) |
| ***E21B 43/38*** | (2006.01) |

(52) U.S. Cl.

CPC ..... *E21B 43/305* (2013.01); *E21B 43/14* (2013.01); *E21B 43/16* (2013.01); *E21B 43/18* (2013.01); *E21B 43/32* (2013.01); *E21B 43/385* (2013.01)

(58) Field of Classification Search

CPC ..... E21B 43/40

USPC ..... 166/245

See application file for complete search history.

(56) References Cited

U.S. PATENT DOCUMENTS

| | | | |
|---|---|---|---|
| 2,713,906 | A | 7/1955 | Allen |
| 5,259,453 | A | 11/1993 | Johnston |
| 5,307,878 | A | 5/1994 | Sydansk |
| 5,320,171 | A | 6/1994 | Laramay |

(Continued)

FOREIGN PATENT DOCUMENTS

| | | |
|---|---|---|
| WO | WO98/25005 | 6/1998 |

OTHER PUBLICATIONS

I. Hermawaty, "Optimum Development on Low Permeability Reservoir—New Phase Opportunity for Mature Badak Field," International Petroleum Technology Conference, Bejing, China, Mar. 26-28, 2013.

(Continued)

*Primary Examiner* — Angela M DiTrani Leff

(74) *Attorney, Agent, or Firm* — Bracewell LLP.; Constance G. Rhebergen

(57) ABSTRACT

A system and method of producing a deposit of gas and liquid hydrocarbons from a subterranean formation, where a pressure of the gas hydrocarbons is regulated. Strategically regulating a pressure of the gas hydrocarbons prevents the gas hydrocarbons from expanding into a path of the liquid hydrocarbons flowing to a wellbore. The liquid hydrocarbons are produced through a production well that is drilled from surface and into a zone within the subterranean formation containing the deposit. A gas expansion circuit is also drilled through the formation, and has a portion that terminates proximate an interface between the gas and liquid hydrocarbons. Thus as the gas hydrocarbons expand into spaces left empty by draining the liquid hydrocarbons, the expanding gas is diverted into the gas expansion circuit rather than into the path of liquid hydrocarbons still in the zone. The gas expansion circuit can have a "fish-bone" configuration.

16 Claims, 9 Drawing Sheets

(56) References Cited

U.S. PATENT DOCUMENTS

| | | | | |
|---|---|---|---|---|
| 5,320,173 | A | 6/1994 | Laramay et al. | |
| 5,322,125 | A | 6/1994 | Sydansk | |
| 5,421,410 | A | 6/1995 | Irani | |
| 5,503,226 | A | 4/1996 | Wadleigh | |
| 5,762,149 | A | 6/1998 | Donovan et al. | |
| 5,855,244 | A | 1/1999 | Ahmed et al. | |
| 6,125,936 | A | 10/2000 | Swisher | |
| 6,321,840 | B1 * | 11/2001 | Billiter | E21B 43/16 166/268 |
| 7,278,481 | B2 * | 10/2007 | Eken | E21B 43/12 166/250.15 |
| 7,921,920 | B1 | 4/2011 | Rosen | |
| 8,307,915 | B2 | 11/2012 | Clark et al. | |
| 8,596,357 | B2 * | 12/2013 | Nenniger | E21B 43/2406 166/272.1 |
| 8,967,297 | B2 | 3/2015 | Orban et al. | |
| 2014/0345855 | A1 * | 11/2014 | Wilfing | E21B 43/2406 166/245 |
| 2014/0345861 | A1 | 11/2014 | Stalder et al. | |
| 2015/0198022 | A1 | 7/2015 | Stanecki et al. | |

OTHER PUBLICATIONS

D. Li, "Intensive Production Enhancement of a Low-Permeability Chinese Oil Reservoir," SPE 168227, Unconventional Natural Resources Conference, Alberta, CA, Nov. 5-7, 2015.

Y. Bigno, "Multilateral Waterflood Development of a Low-Permeability Carbonate Reservoir," SPE Annual Technical conference and Exhibition, New Orleans, LA, Sep. 30-Oct. 3, 2001.

International Search Report and Written Opinion for related PCT application PCT/US2017/053945 dated Nov. 29, 2017.

* cited by examiner

WELLBORE SYSTEM

BACKGROUND OF THE INVENTION

1. Field of Invention

The present disclosure relates to production of hydrocarbons from a subterranean formation. More specifically, the present disclosure relates to regulating pressure along a gas/oil interface in the formation.

2. Description of Prior Art

Hydrocarbons are typically produced from subterranean formations via wellbores that are drilled from the Earth's surface and that intersect the formation. The wellbores are generally lined with casing that is cemented to the wellbore walls, and include production tubing inserted into the casing through which the hydrocarbons are conveyed to surface. Often the hydrocarbons deposits are found trapped within a zone of the formation where a discontinuity of rock type or fracture forms an impervious barrier. Generally, the hydrocarbons include an amount of gas and liquid that become stratified inside the zone based on their respective densities; thus the gas hydrocarbon occupies the upper portion of the zone, and the liquid hydrocarbon is in the lower portion of the zone. Sometimes water is present in the zone, and being more dense than the liquid hydrocarbon, the water typically settles in the lowermost portion of the zone. The untapped deposits are usually at depths where formation pressures are high, so that the gas is in a highly compressed state.

When liquid hydrocarbons are drained from the formation, such as during hydrocarbon production from the subterranean formation, the gas hydrocarbons expand from the compressed state and occupy the portion of the zone left vacant by the migrating liquid hydrocarbons. The expanding gas hydrocarbons exerts a pressure onto the liquid hydrocarbons in the zone, and provide a motive force to urge the liquid hydrocarbons into the wellbore. Typically the wellbore wall and casing is perforated, which provides a pathway for connate fluid from the formation to enter the wellbore. Because the liquid hydrocarbons closest to the wellbore flow into the wellbore ahead of liquid hydrocarbons distal from the wellbore, the expanding gas hydrocarbons can migrate to the wellbore ahead of some of the liquid hydrocarbons of the deposit. Sometimes the gas hydrocarbons surround the wellbore and form a shape resembling a cone, a situation commonly referred to as gas coning. Gas coning usually hinders the flow of liquid hydrocarbons into the wellbore thereby restricting hydrocarbon production. Moreover, when the hydrocarbon gas makes its way between the hydrocarbon liquid and the wellbore, the gas flows into the wellbore, thereby following a low pressure path and expanding as it flows into and up the wellbore. Accordingly, the gas not only interferes with hydrocarbon fluid flow into the wellbore, but the gas expansion no longer provides an urging force against the liquid hydrocarbons.

SUMMARY OF THE INVENTION

Disclosed herein is a system for producing from a subterranean formation and that includes a production wellbore that intersects a zone in the subterranean formation that contains a deposit of gas and liquid hydrocarbons, and a gas expansion circuit that is in selective pressure communication with the deposit, so that when the liquid hydrocarbons flow into the production wellbore and the gas hydrocarbons expand, at least some of the expanding gas hydrocarbons flow into the gas expansion circuit. In one example, the gas expansion circuit includes a motherbore, a deviated portion extending from the motherbore, and lateral wells that project from sides of the deviated portion. When the lateral wells are formed, ends of the lateral wells terminate at a depth that is deeper than a depth of an interface between the gas and liquid hydrocarbons. Further, at a time after liquid hydrocarbons are being produced from the subterranean formation, the interface between the gas and liquid hydrocarbons moves to a depth away from terminal ends of the lateral wells so that terminal ends of the lateral wells are in communication with the gas hydrocarbons. In one embodiment, the lateral wells and deviated portion define a fishbone gas conduit. The deviated portion can be oriented generally oblique with the interface. The deviated portion is optionally oriented generally parallel with the interface. The zone can be a gas cap, and wherein the gas expansion circuit includes a plurality of motherbores that have ends at surface, and opposing ends disposed in flank sections of the zone. The flank sections of the zone can be oriented generally parallel with a contour of a periphery of the zone proximate the ends.

Also described herein is a method of producing hydrocarbons from a zone in a subterranean formation that includes directing a liquid hydrocarbon, that is disposed in the zone, into a wellbore that intersects the subterranean formation, and diverting gas hydrocarbon, that is also disposed in the zone, away from the wellbore by venting at least some of the gas hydrocarbon from the zone. The liquid hydrocarbon and the gas hydrocarbon can define a deposit in the zone. In one example, the gas hydrocarbon is vented from the zone through a gas control well that intersects the zone. The gas control well can include a motherbore, and lateral wells that project radially outward from the motherbore and into the zone. In an alternative, the lateral wells are fishbone wells.

BRIEF DESCRIPTION OF DRAWINGS

Some of the features and benefits of the present invention having been stated, others will become apparent as the description proceeds when taken in conjunction with the accompanying drawings, in which.

Figure 1A:
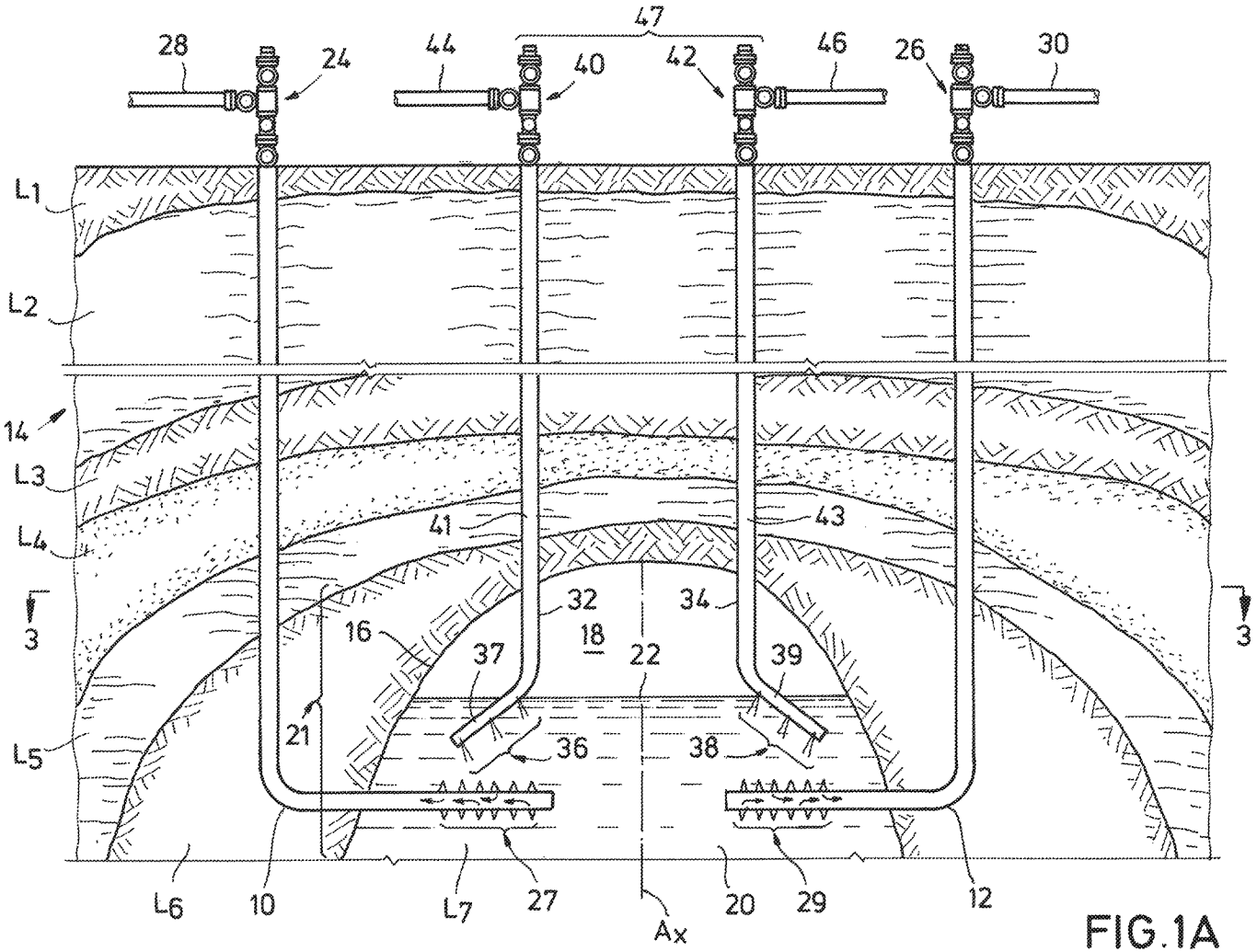
FIG. 1A is a side sectional view of an example of a production well and a gas expansion circuit intersecting a subterranean formation.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/− 5% of the cited magnitude. In an embodiment, usage of the term "substantially" includes +/− 5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side sectional view in FIG. 1A are examples of production wellbores 10, 12 that are each formed vertically through layers $L_{1-7}$ of a formation 14 and whose lower ends terminate within a gas cap 16. In this example, deviated portions of the production wellbores 10, 12 in layer $L_7$ extend in a generally horizontal direction. In the gas cap 16 an amount of gas hydrocarbon 18 and liquid hydrocarbon 20 is trapped under the boundary between layers $L_6$ and $L_7$. This boundary forms the periphery of gas cap 16 and is an impermeable barrier for the hydrocarbons 18, 20. The gas and liquid hydrocarbons 18, 20 define a deposit 21 within the formation 14. An interface 22 is formed along the boundary between the gas and liquid hydrocarbons 18, 20. Optionally, water (not shown) may be included within gas cap 16 and stratified below the liquid hydrocarbon 20. Wellhead assemblies 24, 26 are shown mounted on upper ends of the production wellbores 10, 12 and through which fluid produced from within formation 14 can be controlled and regulated for delivery to be processed. Perforations 27 are shown formed through the sidewalls of production wellbore 10 and project radially outward into the formation 14 inside layer $L_7$. Fluid trapped in the gas cap 16 enters wellbore 10 through perforations 27 where it is routed to wellhead assembly 24. A production line 28 is shown coupled to wellhead assembly 24, which provides a conduit for delivering the produced fluids for offsite transportation and/or processing. Similarly, perforations 29 are formed in the portion of production wellbore 12 within layer $L_7$, and through which fluid can flow into wellhead assembly 26 where it is routed to production line 30.

Over time, as the liquid hydrocarbon 20 is produced from within the gas cap 16, the interface 22 can change from a generally planar configuration to one that is undulating due to the uneven migration of the liquid hydrocarbons 20. As the hydrocarbons 18, 20 are not in free space (such as in a vessel), but instead embedded within subterranean rock, the rock hinders migration of the liquid hydrocarbon 20 into the space left open by liquid hydrocarbons already produced. Thus in currently known production systems the liquid level in the cap rock 16, as reflected by the interface 22, does not fall evenly as liquid hydrocarbon 20 is drawn from the formation 14 into the production wellbores 10, 12. Instead, the interface 22 experiences localized dips in areas above the perforations 27, 29 because the less dense and more freely flowing gas hydrocarbon 18 can flow into openings in the rock as the liquid hydrocarbons 20 migrate from those openings before other liquid can replace the migrated liquid. Accordingly, the gas hydrocarbon 18 can make its way to the perforations 27, 29 ahead of liquid hydrocarbon 20 laterally offset from these perforations 27, 29.

Still referring to FIG. 1A, shown are gas control wells 32, 34 that are used to regulate pressure in the gas cap 16 during hydrocarbon production, and thereby avoid the problem of gas flow and expansion limiting production of liquid hydrocarbons. In an example the gas control wells 32, 34, provide a low pressure destination for the gas hydrocarbons 18. As shown, gas control well 32 includes lateral wells 36 that project into the portion of the gas cap 16 having the liquid hydrocarbon 20. The lateral wells 36 extend from a deviated portion 37 of gas control well 32, and which is oriented generally oblique with the interface 22. Gas control well 34 also includes lateral wells 38 that are in the portion of the cap rock 16 having the liquid hydrocarbon 20 and that project from a deviated portion 39 of gas control well 34. Gas control wells 32, 34 provide a low pressure pathway for the gas hydrocarbons 18 before they reach the perforations 27, 29; which can avoid restricting or impeding flow of liquid hydrocarbons 20 into the production wellbores 10, 12 by the gas hydrocarbons 18. Moreover, as is known, the expansion of the gas hydrocarbons 18 with corresponding depletion of liquid hydrocarbon 20 provides a motive force for urging the liquid hydrocarbons 20 into the production wellbores 10, 12. Again, the strategic positioning of the gas control wells 32, 34 helps to balance the gas pressures within the gas cap, thereby maintaining a more planar orientation of interface 22. Thus, gas hydrocarbons 18 may enter into gas control well 32 via the lateral wells 36, into the deviated portion 37 and that are transported to a wellhead assembly 40 on surface. A mother bore 41 is included with gas control well 32 that connects the deviated portion 37 to wellhead assembly 40. Similarly, gas control well 34 attaches to a lower end of a wellhead assembly 42 on surface and which also connects to a mother bore 43 that provides fluid communication between deviated portion 39 and wellhead assembly 42. Production lines 44, 46 respectively couple to wellhead assemblies 40, 42, which provide conduits for delivering produced fluids for offsite transportation and/or processing. The combination of gas control wells 32, 34 and their respective bores and wellhead assemblies 40, 42 define a gas expansion circuit 47. In an embodiment, the deviated portions 37, 39 are disposed along the flank portion of gas cap 16, which is one example is proximate the interface of layers $L_6$ and $L_7$ and distal from axis $A_X$.

Figure 1B:
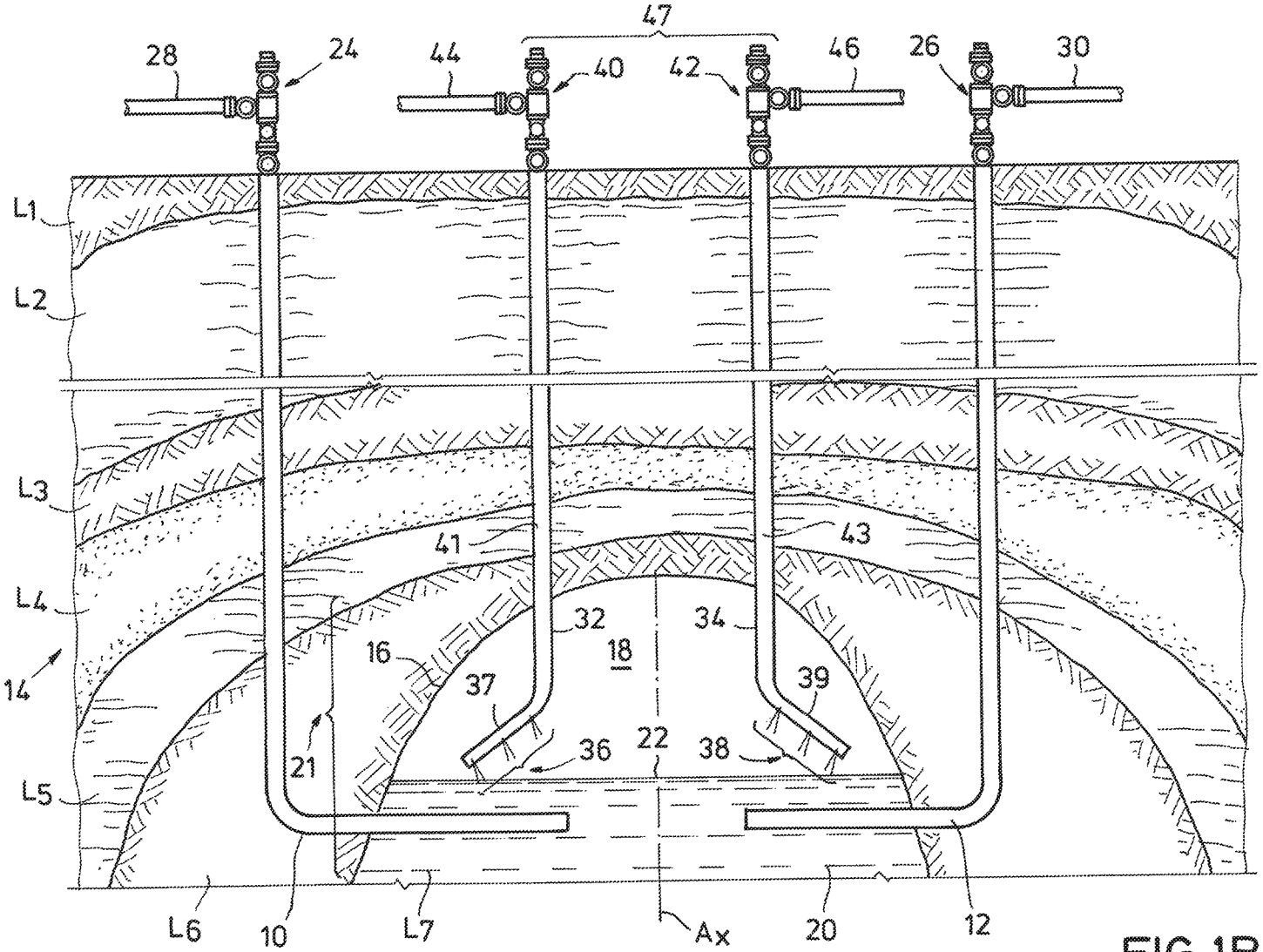
FIG. 1B is a side sectional view of the formation of FIG. 1A after a period of time after hydrocarbons have been produced from the formation.

Referring now to FIG. 1B, represented here is a side sectional view of the gas cap 16 and formation 14 at a later point in time from that of FIG. 1A, and wherein the interface 22 is shown at a depth that is greater than its position in FIG. 1A. The relocation of the interface 22 is because an amount of liquid hydrocarbon 20 has been produced from within the cap rock 16 and transported to surface via the production wellbores 10, 12. Absent the gas expansion circuit 47, interface 22 would otherwise have a curved or undulating configuration as described above; and allowing gas hydrocarbon 18 to reach the perforations 27, 29 ahead of liquid hydrocarbons 20, thereby blocking or hindering flow of liquid hydrocarbons 20 into the production wellbore 10, 12. Thus, one of the advantages of the gas expansion circuit 47 is that it prevents the condition known as gas coning. Further illustrated is an axis AX within gas cap 16 that extends in a direction that is generally perpendicular with that of interface 22 and generally parallel with the vertical portions of the production wellbores 10, 12. In one example, gas control wells 32, 34 are drilled from surface and inside the gas cap 16 they include the deviated portions 37, 39. The gas control wells 32, 34, are completed and lined with casing (not shown). The lateral wells 36, 38 are then drilled and completed as open hole.

Figure 2:
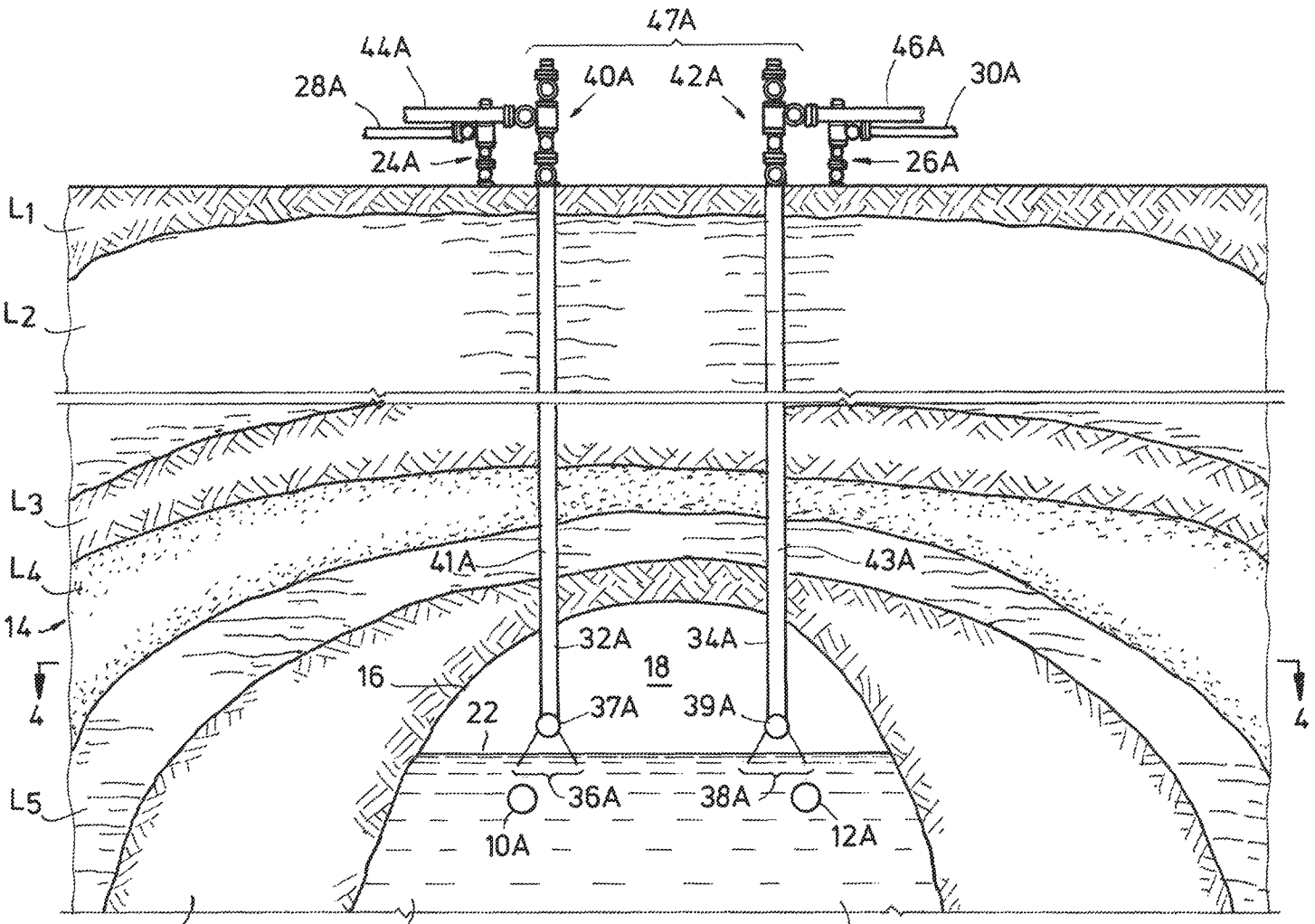
FIG. 2 is a side sectional view of an alternate example of a production well and a gas expansion circuit intersecting a subterranean formation.

FIG. 2 shows in side sectional view an alternate example of gas expansion circuit 47A that is used for controlling pressure within gas cap 16 and migration of gas hydrocarbon 18 within gas cap 16. In this example the deviated portions 37A, 39A of gas control wells 32A, 34A run generally parallel with interface 22 and do not terminate at a depth below interface 22 prior to when hydrocarbons are being produced from within formation 14. In this example, lateral wells 36A, 38A project obliquely downward from sides of the deviated portions 37A, 39A and terminate at a depth that is below the depth of interface 22. Further in this example, the associated mother bores 41A, 43A are strategically positioned so that the deviated portions 37A, 39A extend along a flank of the gas cap 16 and so that a maximum amount of liquid hydrocarbons 20 can be produced from within gas cap 16. Embodiments exist wherein the flank of the gas cap 16 is the portion or region adjacent its outer lateral periphery and spaced radially away from the axis AX. Further shown are the ends of the production wellbores 10A, 12A and which extend along paths within the gas cap 16 that are generally parallel with the deviated portions 37A, 39A. In an example, fluids produced by wellhead assemblies 24A, 26A, 40A, 42A are transported for processing via production lines 28A, 30A, 44A, 46A respectively.

Figure 3:
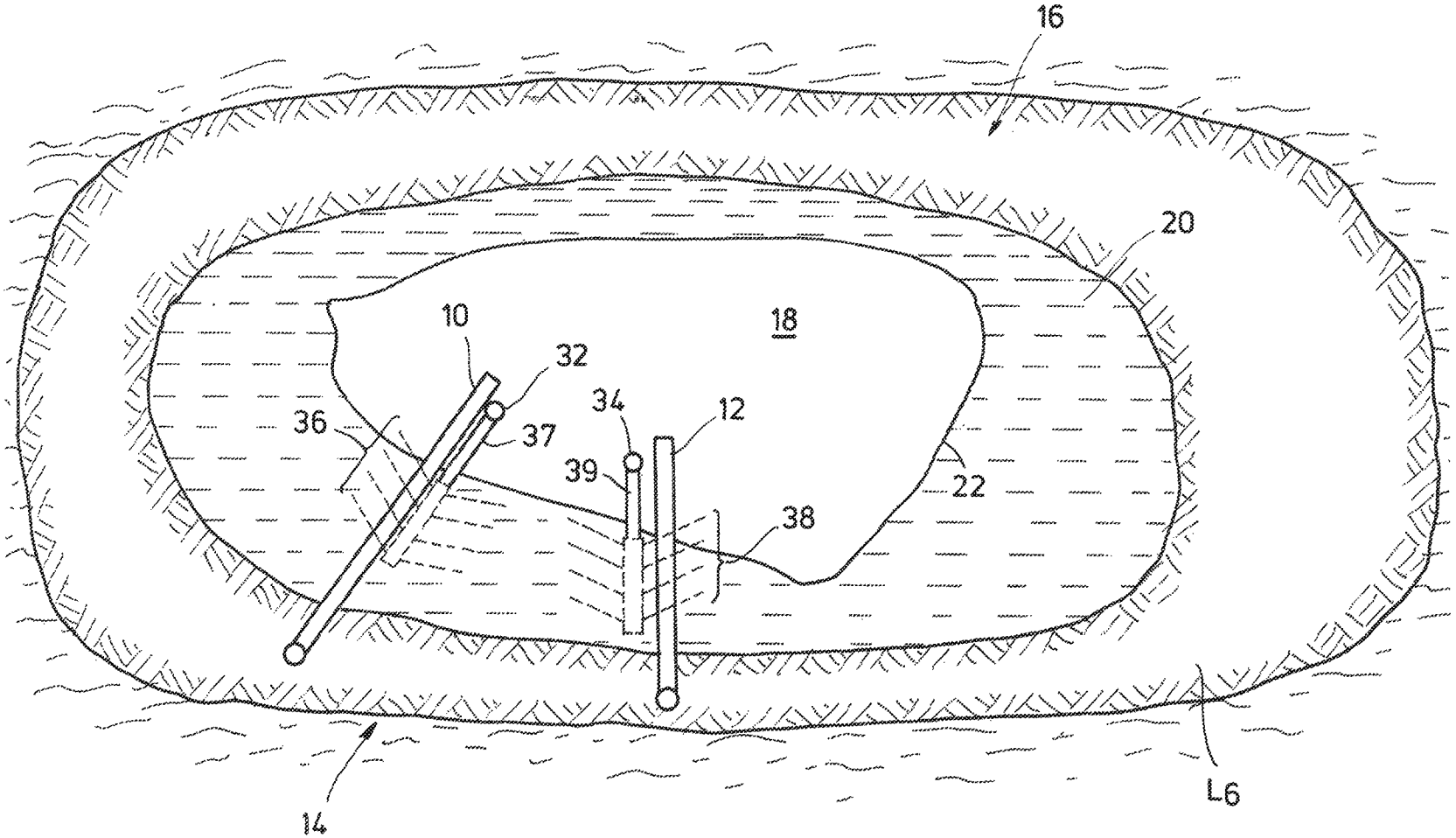
FIG. 3 is a plan view of the formation of FIG. 1A and taken along lines 3-3.

Referring now to FIG. 3, a plan view of formation 14 is schematically illustrated and which is taken along lines 3-3 of FIG. 1A. In this example the deviated portions 37, 39 are shown extending from within the portion of gas cap 16 having the gas hydrocarbon 18, and terminating within the portion of gas cap 16 having the liquid hydrocarbon 20. Thus, the portions of the deviated portions 37, 39 dipping below interface 22 are illustrated in a dashed outline. As the lateral wells 36, 38 are initially within the liquid hydrocarbon portion of gas cap 16, these are shown also in a dashed outline. Moreover, as illustrated in this plan view, the orientation of the lateral wells 36, 38 are generally parallel with one another and project in oblique directions to the axes of the deviated portions 37, 39, thereby having what is referred to as a fishbone-type arrangement.

Figure 4:
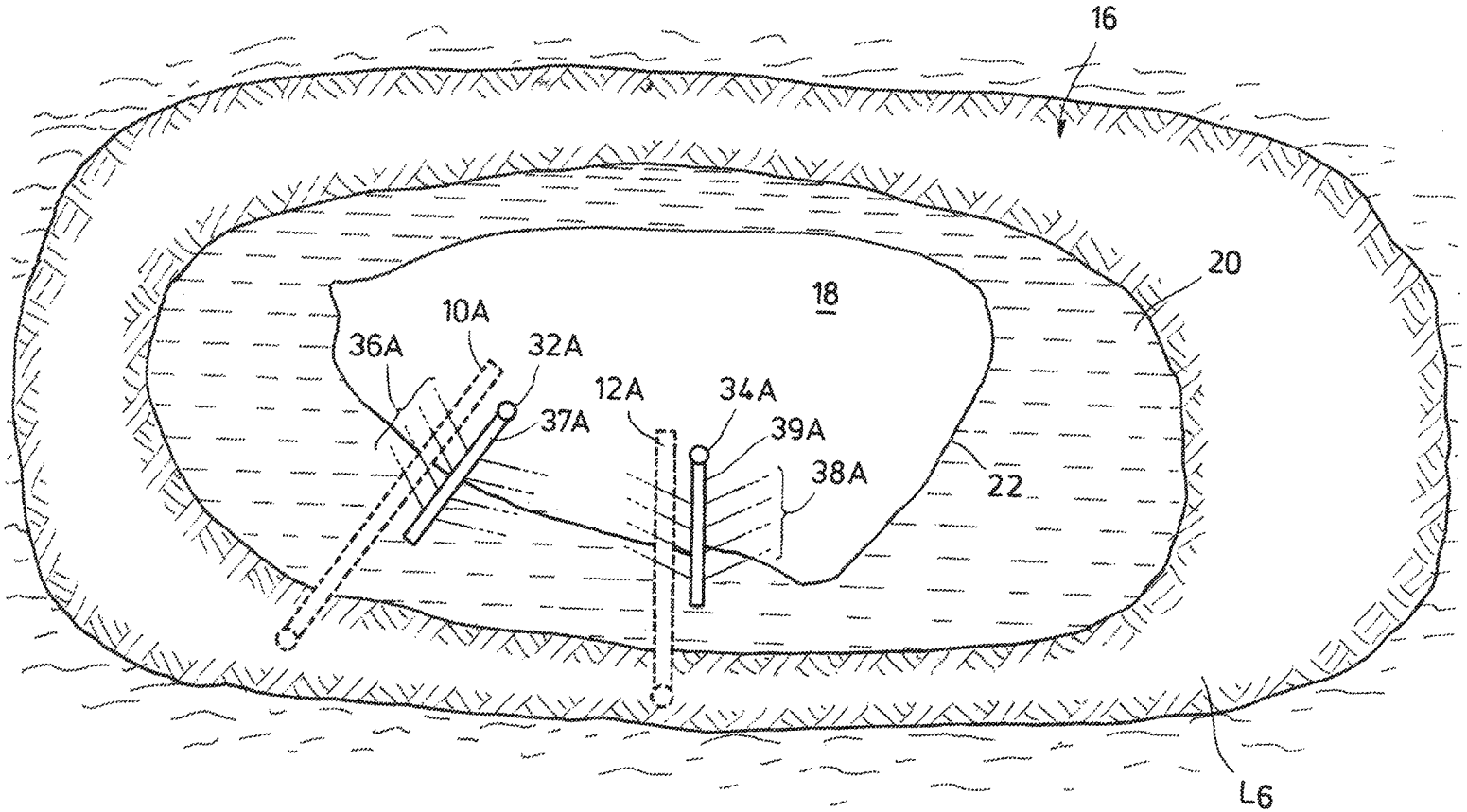
FIG. 4 is a plan view of the formation of FIG. 2 and taken along lines 4-4.

FIG. 4, which is taken along lines 4-4 of FIG. 2, shows a plan view of the formation 14 of FIG. 2 and here, the deviated portions 37A, 39A are all within the portion of the gas cap 16 having the gas hydrocarbon 18, and thus are shown in solid line form. However, as terminal ends of the lateral wells 36A, 38A depend downward into the portion of gas cap 16 having the liquid hydrocarbon 20, these sections are shown in a dashed outline to represent the transition into the strata containing the different type of hydrocarbon. In both FIGS. 3 and 4, the lateral wells 36, 36A, 38, 38A are generally parallel with the production wellbores 10, 10A, 12, 12A. However, embodiments exist wherein these wellbores are oblique or perpendicular with one another. As shown, the orientations may be oblique in any of the X, Y or Z planes.

Figure 5:
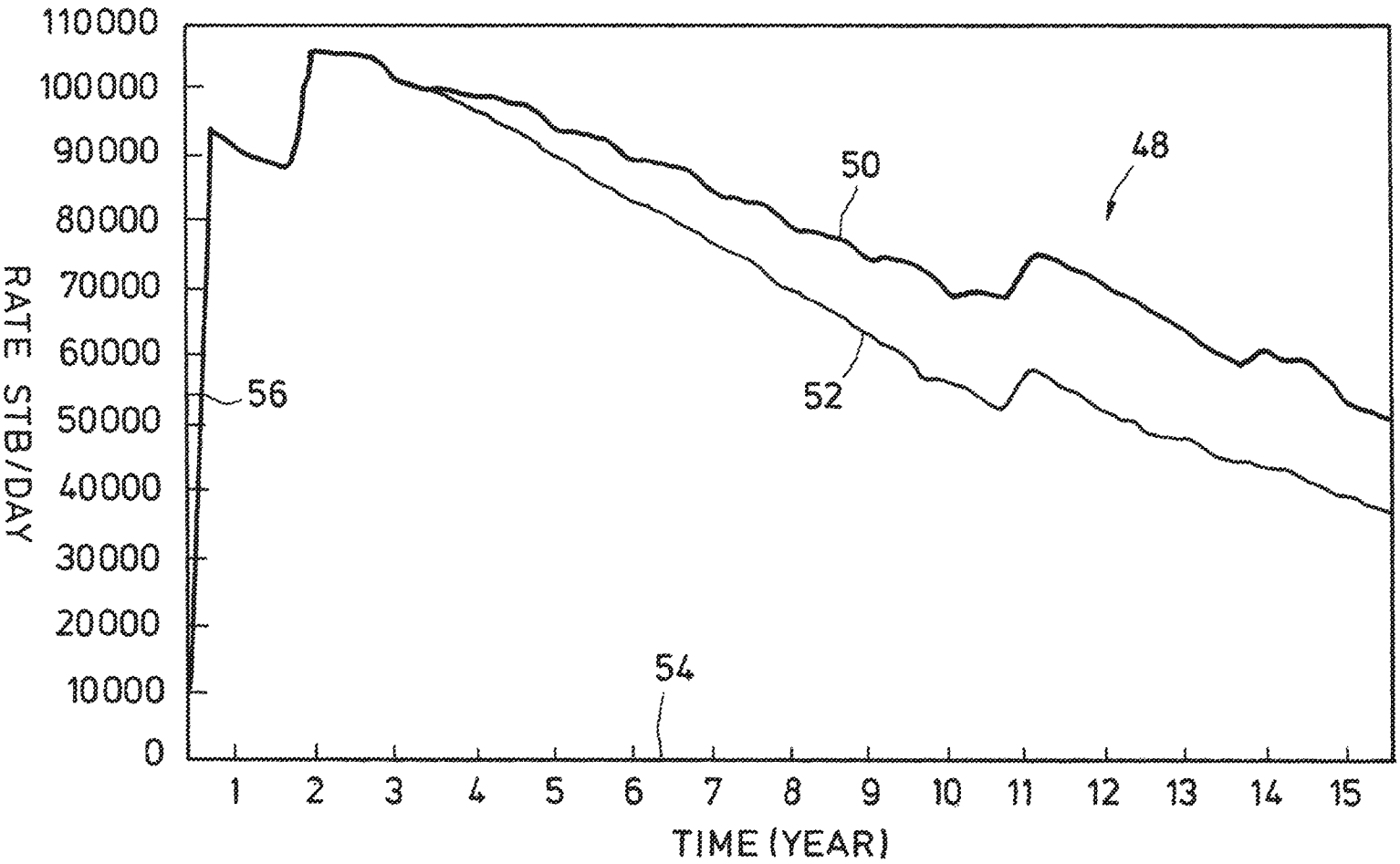
FIG. 5 is a graph of projected oil production rates of the production well and gas expansion circuit of FIG. 1A and a prior production system.

FIGS. 5 through 8 illustrate projected data of producing a formation with a prior art wellbore system, i.e., one not addressing the expansion of the gas hydrocarbon within the formation, and a wellbore that does have such a compensation system as described herein. In an embodiment, the data represented in FIGS. 5 through 8 is generated using a commercial software, such as Eclipse, and which generates a geological/reservoir simulation model to predict a production profile. Referring to FIG. 5, illustrated is a graph 48 having lines 50, 52 that each represent projections of oil produced over time. The abscissa 54 of graph 48 represents projected time in years going out from an initial production date; ordinate 56 of graph 48 provides scaled values of a flow rate in million barrels per year of oil produced from the wellbore. Line 50 represents the production of oil from the formation over time using the enhanced production system and method described herein (i.e. a gas expansion circuit 47, 47A). Line 52 represents a projected production rate of oil from the same formation as that used in forming line 50. The data for line 52 was generated based on a production scheme without gas expansion compensation, and therefore one prone to production blockage or stoppages due to interference by the expansion in the gas. As seen in FIG. 5, beginning at around year four, the rate values of line 50 are increasingly greater than those for line 52. This indicates that oil production over time using the gas expansion circuits 47, 47A described herein is greater than that of using a prior art system. Thus, over the anticipated life of a particular well, a significantly greater amount of oil may be produced from the well as it would not be trapped within a zone by the uneven introduction of gas adjacent a wellbore entrance.

Figure 6:
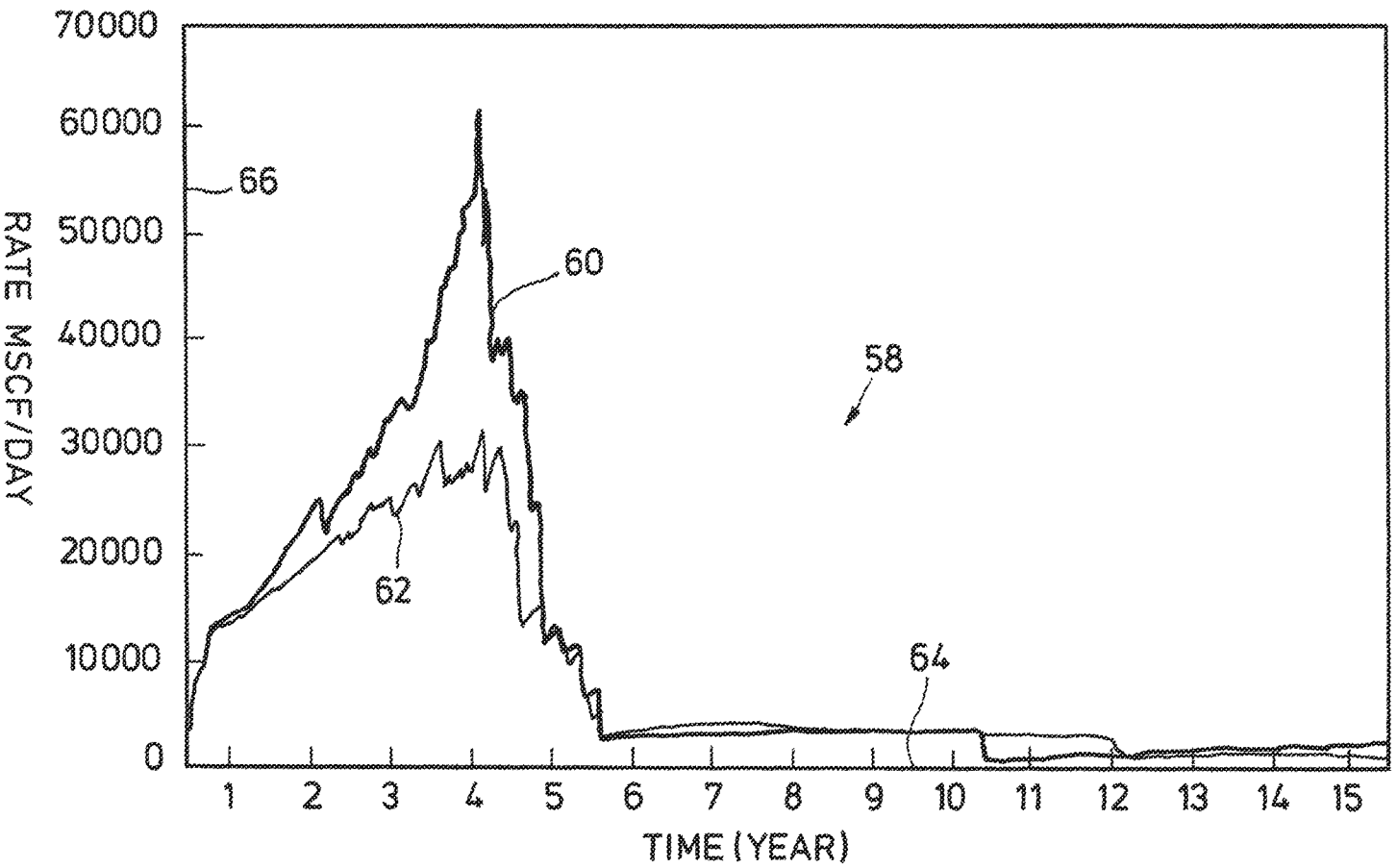
FIG. 6 is a graph of projected gas production rates of the production well and gas expansion circuit of FIG. 1A and a prior production system.

Similarly, FIG. 6 which is a graph 58 depicting the production of gas from a wellbore, wherein line 60 represents gas production over time using an example of a gas expansion circuit described herein, and line 62 represents gas produced from a well having a prior art system. The abscissa 64 represents time in years, and the ordinate 66 of graph 58 represents a flow of gas in million standard cubic feet per year. Like the graph 48 of FIG. 5, it is shown that a production system having a gas expansion circuit to produce hydrocarbons from a formation also results in a greater amount of gas produced from the wellbore.

Figure 7:
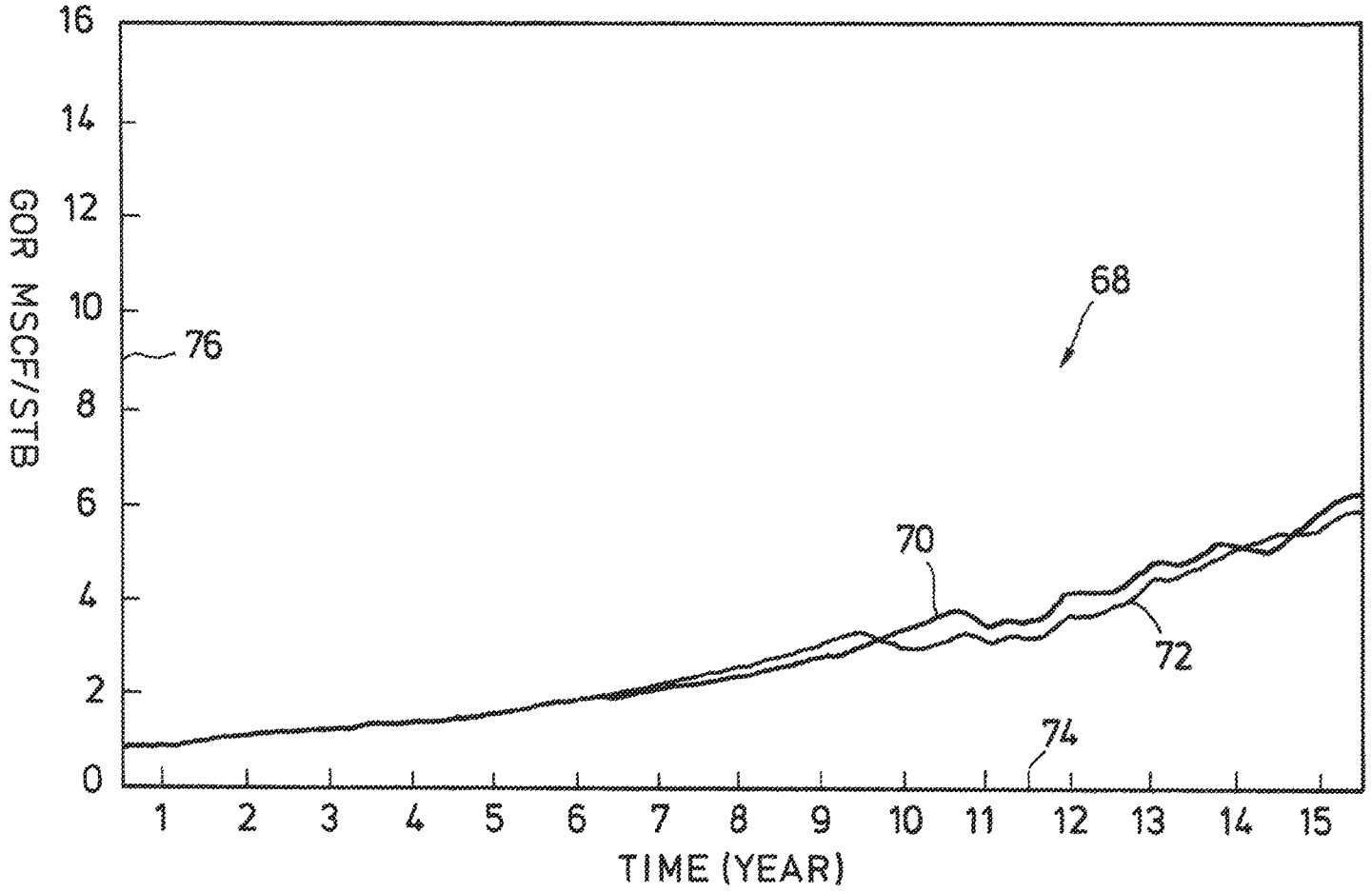
FIG. 7 is a graph of projected gas oil ratios of the production well and gas expansion circuit of FIG. 1A and a prior production system.

Illustrated in the example of FIG. 7 is a graph 68 having lines 70 and 72, where line 70 represents a gas oil ratio over time experienced using a prior art well system, and line 72 shows a gas oil ratio over time implementing the well production system described herein. In FIG. 7 the abscissa 74 represents time in years, and the ordinate 76 represents gas oil ratio of million barrels over million cubic feet. In this graph, the gas oil ratio of the two different scenarios remains roughly similar over the lifetime of the well.

Figure 8:
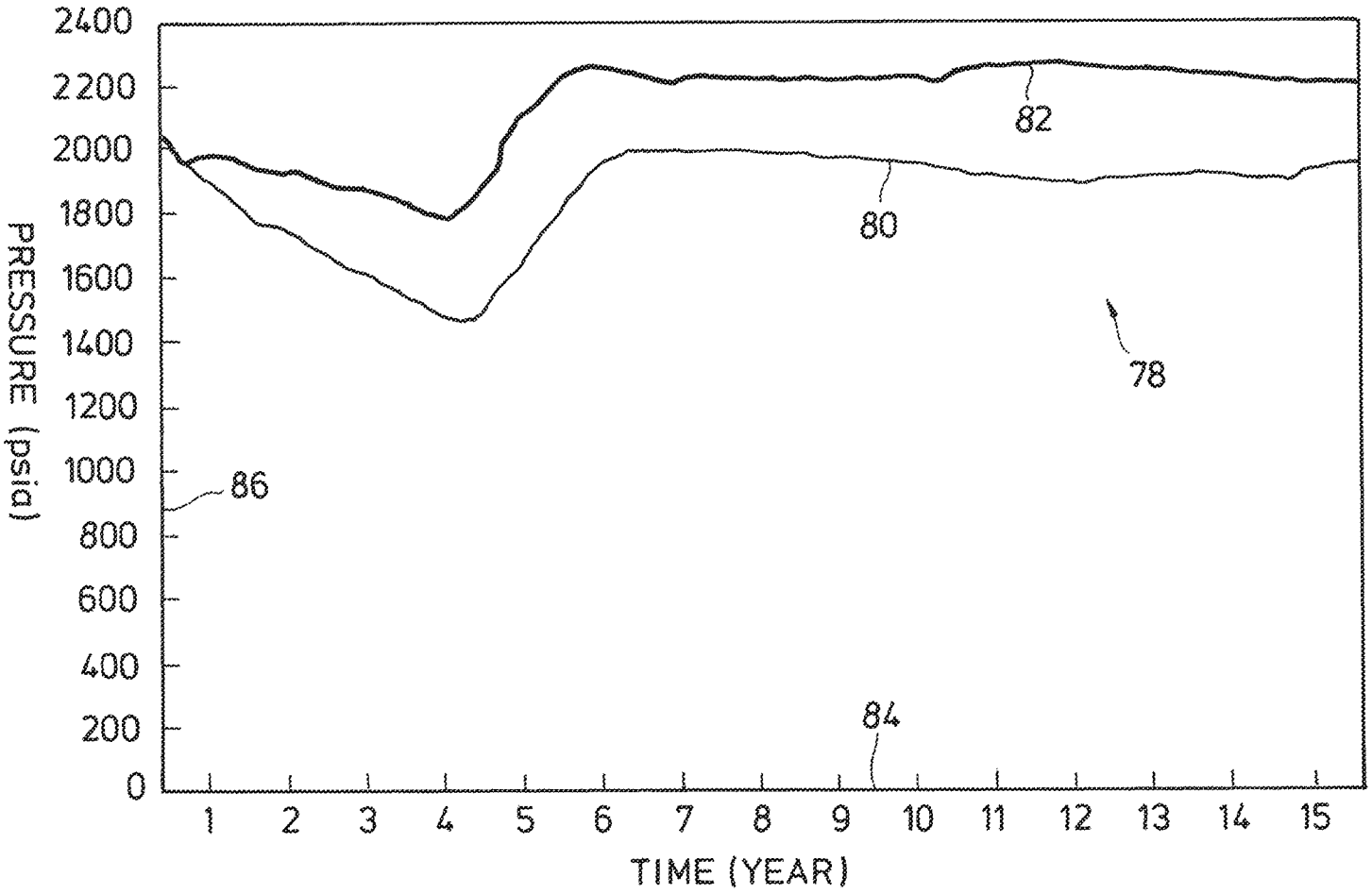
FIG. 8 is a graph of projected bore hole pressures of the production well and gas expansion circuit of FIG. 1A and a prior production system.

Provided in FIG. 8 is a graph 78 having a line 82 that represents pressure within a well over time where its production hardware includes a gas expansion circuit as described herein. Line 80 pressure of the well over time, but where its production hardware utilizes a prior art system and without compensation for gas expansion. Abscissa 84 of graph 78 is a scale of the time per year of the recorded pressures, and ordinate 86 represents pressure in pounds per square inch (psi) in the wellbore. Accordingly, as shown, the pressure within the wellbore having the gas expansion circuit described herein experiences higher pressures over time and consistently over that of a prior art well.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, a pressure gauge (not shown) can be included downhole with the gas expansion circuit 47 (FIG. 1A) for monitoring pressure within gas cap 16. These and other similar modifications will readily suggest themselves to those skilled in the art, and are intended to be encompassed within the spirit of the present invention disclosed herein and the scope of the appended claims.

What is claimed is:

1. A system for producing from a subterranean formation comprising:

a production wellbore that intersects a zone in the subterranean formation containing a deposit of gas and liquid hydrocarbons that contact one another along a gas and liquid interface;

perforations on a portion of the production wellbore that is disposed on a liquid side of the interface;

a gas expansion circuit that intersects the zone and is in selective pressure communication with the deposit, and that comprises, a motherbore, a deviated portion extending from the motherbore, and lateral wells that project from sides of the deviated portion and that have ends terminating at a depth greater than the interface when the lateral wells are formed, so that when the liquid hydrocarbons flow into the production wellbore and the gas hydrocarbons expand, at least some of the expanding gas hydrocarbons flow into the gas expansion circuit, the interface is maintained in a planar configuration, and liquid hydrocarbons are between the perforations and gas hydrocarbons remaining on a gas side of the interface that is opposite from the liquid side; and an inlet on a portion of a gas control wellbore that is on the gas side of the interface.

2. The system of claim 1, wherein at a time after liquid hydrocarbons are being produced from the subterranean formation, the interface between the gas and liquid hydrocarbons moves to a depth away from terminal ends of the lateral wells so that terminal ends of the lateral wells are in communication with the gas hydrocarbons.

3. The system of claim 1, wherein the lateral wells and deviated portion comprise a fishbone gas conduit.

4. The system of claim 1, wherein the deviated portion is oriented oblique with the interface.

5. The system of claim 1, wherein the deviated portion is oriented substantially parallel with the interface.

6. The system of claim 1, wherein the zone comprises a gas cap, and wherein the gas expansion circuit comprises a plurality of motherbores that have ends at surface, and opposing ends disposed in flank sections of the zone.

7. The system of claim 6, wherein the ends in the flank sections of the zone are oriented substantially parallel with a contour of a periphery of the zone proximate the ends.

8. A method of producing from a subterranean formation comprising:

directing a liquid hydrocarbon from within a gas cap and into a wellbore that intersects the subterranean formation;

preventing gas hydrocarbon in the formation from expanding into a path of liquid hydrocarbons flowing to an inlet to the wellbore by controlling a pressure of the gas hydrocarbon that is in the gas cap and at a lesser depth than the liquid hydrocarbon; and balancing a pressure in the gas cap by venting at least some of the gas hydrocarbon.

9. The method of claim 8, wherein the liquid hydrocarbon and the gas hydrocarbon define a deposit in the zone.

10. The method of claim 8, wherein gas hydrocarbon is vented from the zone through a gas control well that intersects the zone, wherein an interface between the gas hydrocarbon and liquid hydrocarbon is at a depth in the formation that changes over time, and wherein a portion of the gas control well is at a depth greater than the depth of the interface when the gas control well is formed.

11. The method of claim 10, wherein the gas control well comprises a motherbore, and lateral wells that project radially outward from the motherbore and into the zone.

12. The method of claim 11, wherein the lateral wells comprise fishbone wells.

13. The method of claim 11, wherein venting the gas hydrocarbons controls a pressure of the gas in the cone so that an interface between the liquid hydrocarbons and gas hydrocarbons is maintained in a planar orientation.

14. A method of producing from a subterranean formation comprising:

producing liquid hydrocarbons through a liquid hydrocarbon production wellbore and from within a gas cap in the formation in which gas hydrocarbons resides at a lesser depth than the liquid hydrocarbons, and is in contact with the liquid hydrocarbons along an interface;

producing gas hydrocarbons from the gas cap through a gas hydrocarbon wellbore that is spaced away from the liquid hydrocarbon production wellbore; and controlling a pressure of the gas hydrocarbons in the gas cap with the gas hydrocarbon wellbore.

15. The method of claim 14, wherein the interface intersects openings in subterranean rock disposed in the gas cap.

16. The method of claim 14, wherein the step of controlling a pressure of the gas hydrocarbon in the gas cap maintains the interface away from an inlet to the liquid hydrocarbon wellbore.

* * * * *